US006312194B1

(12) United States Patent
Simons

(10) Patent No.: US 6,312,194 B1
(45) Date of Patent: Nov. 6, 2001

(54) DEVICE FOR EXCAVATING AND REDEPOSITING EARTH

(75) Inventor: Dieter Simons, Buchholz (DE)

(73) Assignees: Wirtgen GmbH; Karl-OttoHeber, both of (DE)

( * ) Notice: Subject to any disclaimer, the term of this patent is extended or adjusted under 35 U.S.C. 154(b) by 0 days.

(21) Appl. No.: 09/446,612

(22) PCT Filed: May 12, 1998

(86) PCT No.: PCT/EP98/02756

§ 371 Date: Dec. 27, 1999

§ 102(e) Date: Dec. 27, 1999

(87) PCT Pub. No.: WO99/00555

PCT Pub. Date: Jan. 7, 1999

(30) Foreign Application Priority Data

Jun. 28, 1997 (DE) ..... 197 27 549

(51) Int. Cl.[7] ..... E02F 3/96

(52) U.S. Cl. ..... 405/179; 37/365; 37/379; 37/443; 37/444; 414/722

(58) Field of Search ..... 405/154, 179, 405/157; 37/444, 443, 365, 364, 379, 403, 409, 410, 901, 923; 414/722, 723, 724, 725

(56) References Cited

U.S. PATENT DOCUMENTS

| | | | | |
|---|---|---|---|---|
| 4,023,288 | * | 5/1977 | Roe | 37/403 |
| 4,100,688 | * | 7/1978 | Grist | 37/403 |
| 4,793,732 | * | 12/1988 | Jordon | 404/90 |
| 4,852,277 | * | 8/1989 | Ward | 37/403 |
| 4,943,165 | * | 7/1990 | Boggs | 37/443 |
| 5,379,534 | * | 1/1995 | Negishi | 37/443 |

* cited by examiner

*Primary Examiner*—David Bagnell
*Assistant Examiner*—Frederick L. Lagman
(74) *Attorney, Agent, or Firm*—Diller, Ramik & Wight

(57) ABSTRACT

A device for digging and backfilling of ditches, in particular for laying pipes, comprising an automotive travelling mechanism (2) carrying a machine frame (4) with an upper structure, a boom (6) pivoted on the machine frame (4) and having a plurality of boom arms (8, 10, 12) connected with each other with hinges and an excavator bucket (16) pivoted on the free end of the boom (6) is provided with a milling/mixing rotor (22) mounted to the excavator bucket (16).

14 Claims, 4 Drawing Sheets

DEVICE FOR EXCAVATING AND REDEPOSITING EARTH

BACKGROUND OF THE INVENTION

The invention relates to a device and a process for excavating and backfilling of soil, in particular for laying of pipes in ditches.

When ditches are excavated, in particular for the purpose of laying pipes, excavators are used which comprise a pivoted excavator bucket at the end of a boom. The boom is made up of a plurality of boom arms connected to each other with hinges, which allow a given movement of the excavator bucket controlled by an operator or a control unit. The ditches in which the pipes are laid are approximately 3 m deep and approximately 1.20 m wide.

During conventional laying of pipes first the ditch is dug and the excavated material transported to a dump site. Then a supporting layer for the pipes is prepared in the soil and the pipes are embedded up to at least half their diameter in a grit or gravel layer.

Filler capable of being packed is supplied, fed into the ditch and packed. The ditch is then filled with crushed stone and covered with asphalt, if necessary.

This procedure presents several drawbacks. Removal of the excavated soil and dumping of the excavated material on a dump site involves costs of approximately DM 40/m$^3$. From the ecological point of view dumping of the soil is unnecessary. Further costs arise for the filler supplied. Furthermore, removal and delivery of the materials by truck require thorough logistic planning. The site must be cordoned-off to a large extent to control the truck traffic so that it is not possible to set up a small mobile site. Finally progress of work depends to a large extent on the traffic and that the waste is continuously removed in due time and the filler is continuously delivered in due time.

SUMMARY OF THE INVENTION

It is the object of the invention to provide a device and a process for excavating and backfilling of soil, which allow a more rapid progress of work with simultaneous saving of base material and reduction of waste.

The invention preferably provides for a milling/mixing rotor to be mounted on the excavator bucket. The arrangement of the milling/mixing rotor on the excavator bucket preferably allows different working cycles to be carried out using one and the same site vehicle. First the excavator bucket can be used in a conventional way for excavating and backfilling of soil. With the aid of the milling/mixing rotor the soil can be milled, loosened and comminuted in a separate working cycle so that the excavated soil can be reused.

The volume of the excavator bucket is divided into a receiving chamber for the excavated material and a mixing chamber for the milling/mixing rotor. The mixing chamber surrounds the milling/mixing rotor and is not connected with the receiving chamber of the excavator bucket.

A spray means can spray a liquid binder into the mixing chamber of the excavator bucket.

In this way binder is fed during milling of a layer and mixed with the loosened and comminuted material. The treated material can then be used as filler. The excavator bucket may further comprise a distribution means for powdered binder.

For this purpose the excavator bucket preferably comprises a storage chamber for powdered binder. Said storage chamber may e.g. be arranged in the rear portion of the excavator bucket.

The powdered binder may be distributed from the storage chamber with the aid of a rotary lock preferably arranged behind the milling/mixing rotor. The rotary lock is arranged axially parallel to the milling/mixing rotor.

A control unit may control the travel of the excavator buckets in dependence on the position of the boom arms with the given milling depth being adjusted.

In this way the path of the excavator bucket is kept constant with the milling depth being kept constant, too, without the operator having to carry out complicated steering movements.

The milling/mixing rotor is partially surrounded by a circularly curved covering hood in the excavator bucket with the covering hood defining the mixing chamber in the excavator bucket. The milling/mixing rotor is mounted in the side walls of the excavator bucket laterally defining the covering hood.

The process according to the invention preferably provides for the first ditch section to be excavated in a conventional manner with the excavated material being removed, a supporting layer being prepared and pipes being placed and embedded in a grit and gravel layer in the first ditch section, and for the following ditch section to be first milled in several layers at a given milling depth with the milled material being simultaneously loosened and mixed and binder being added. The material treated this way is excavated and placed as filler onto the pipes located directly upstream. When work is started, a first ditch section is first prepared in a conventional manner for laying of approximately 1 to 3 pipe/pipes and for being backfilled after laying of the pipes. The following ditch section is not excavated by the excavator bucket in a conventional manner but prepared with the aid of a milling/mixing rotor and the milled material is removed layer-wise along a fixed path. During milling, loosening and comminution of the material layer binder is added and admixed to the loosened layer. Only then is the loosened and treated layer excavated with the same excavator bucket in excavating position and placed as filler onto the pipes located directly upstream. When the filler for the pipes in the first ditch section has been completely unloaded, a corresponding second upstream ditch section is cleared into which 1 to 3 pipe/pipes can be placed so that treated soil can be used again as filler during the following working cycle.

The process according to the invention presents the essential advantage that the excavated soil can be used as filler after having been treated and binder having been added, which makes the complete removal of the excavated material and delivery of the required filler superfluous. Costs for dumping and filler as well as for removal of the soil and delivery of the filler are thus saved.

Owing to the fact that transports are not necessary a continuous progress of work is possible so that the working time and the size of the site can be reduced. Finally the traffic to and from the site is considerably reduced either since only the material for the grit, gravel and crushed stone layers must be delivered and small amounts of waste must be removed.

BRIEF DESCRIPTION OF THE DRAWINGS

Hereunder an embodiment of the invention is explained in detail with reference to the drawings in which.

DESCRIPTION OF THE PREFERRED EMBODIMENTS

Figure 1:
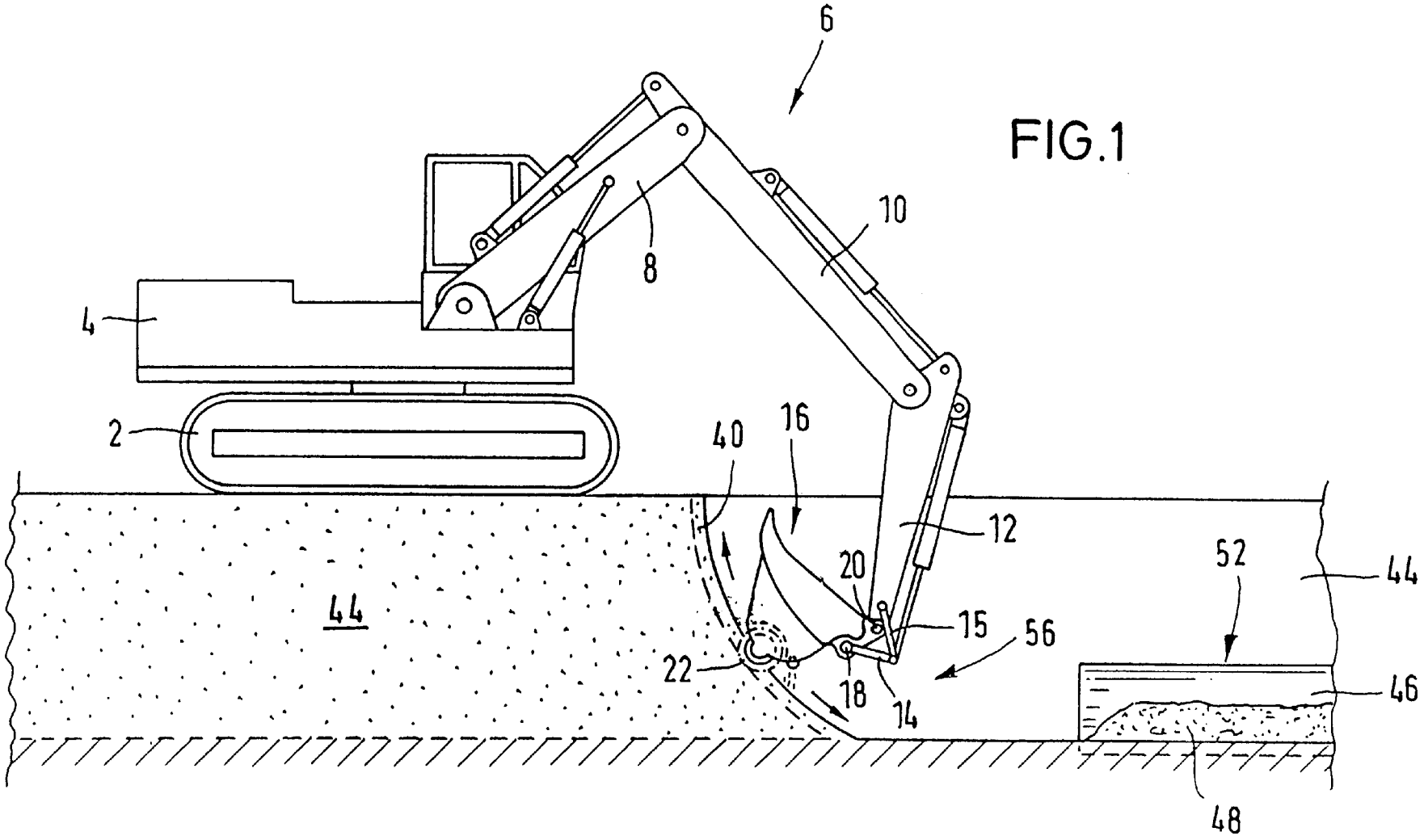
FIG. 1 shows milling of the soil in an area upstream of the pipe.

An excavator comprising a travelling mechanism 2 carrying a machine frame 4 with an upper structure can move along a path, with the aid of a control unit, an excavator bucket 16 arranged at a free end of the boom 6. The boom 6 comprises a plurality of boom arms 8, 10, 12 connected with each other with hinges, which allow the excavator bucket 16 to carry out complex movements. The excavator bucket 16 has two hinges 18, 20 which allow, via control arms 14, 15, the elevator bucket 16 to pivot relatively to the boom arm 12.

The excavator is positioned at ground level above a ditch to be dug in the soil 44.

Pipes 46 are placed into the ditch with the work being carried out section-wise in ditch sections. In each ditch section approximately 1 to 3 pipe/pipes 46 can be laid one behind the other with the excavated soil 44 from the ditch section 56 upstream of the pipes 46 being used as filler for the ditch section 52 containing the pipes 46.

Figure 4:
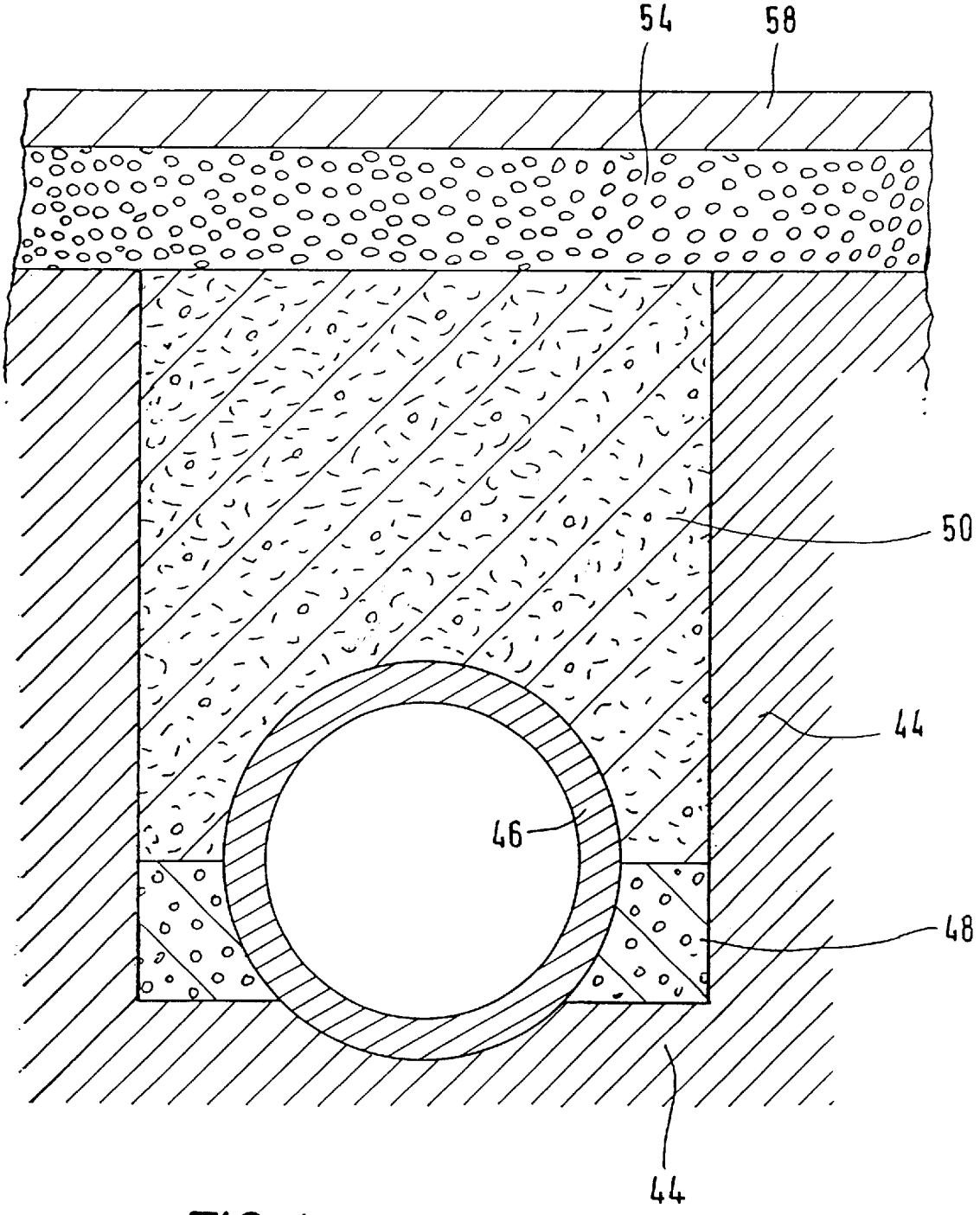
FIG. 4 shows a cross-section of a ditch in which a pipe has been laid.

A cross-section of the ditch containing pipe 46 is shown in FIG. 4. After digging of the ditch first a bottom or supporting layer for the pipes 46 is prepared in the soil 44 by horizontally drawing off the bottom of the ditch with a conduit for accommodating the pipes being provided, if necessary. The path of the excavator bucket is preferably controlled with the aid of an excavator levelling system. Subsequently a grit layer 8, 11 and/or a gravel layer 48 with a particle size of <20 mm is formed into which the pipes 46 are embedded up to half of their diameter. Filler 50 is placed onto said grit or gravel layer 48 and the portion of the pipes 46 projecting from the grit or gravel layer 48 with the filler being packed, if necessary. A crushed stone layer 54 may be provided above the filler layer 50 and an asphalt layer 58 may be provided as the uppermost layer.

FIG. 1 shows milling of a ditch section 56 upstream of the pipes 46 in the ditch section 52 with the aid of a milling/mixing rotor 22 mounted to the excavator bucket 16. In the embodiment shown in FIG. 1 the milling/mixing rotor 22 is mounted on the lower side of the excavator bucket 16 in the side walls 28 of the excavator bucket 16. A covering hood 23 surrounds the portion of the milling/mixing rotor facing the excavator bucket 16 and surrounds a mixing chamber 26 in which the soil material 44 milled layer-wise is loosened and comminuted.

Figure 3:
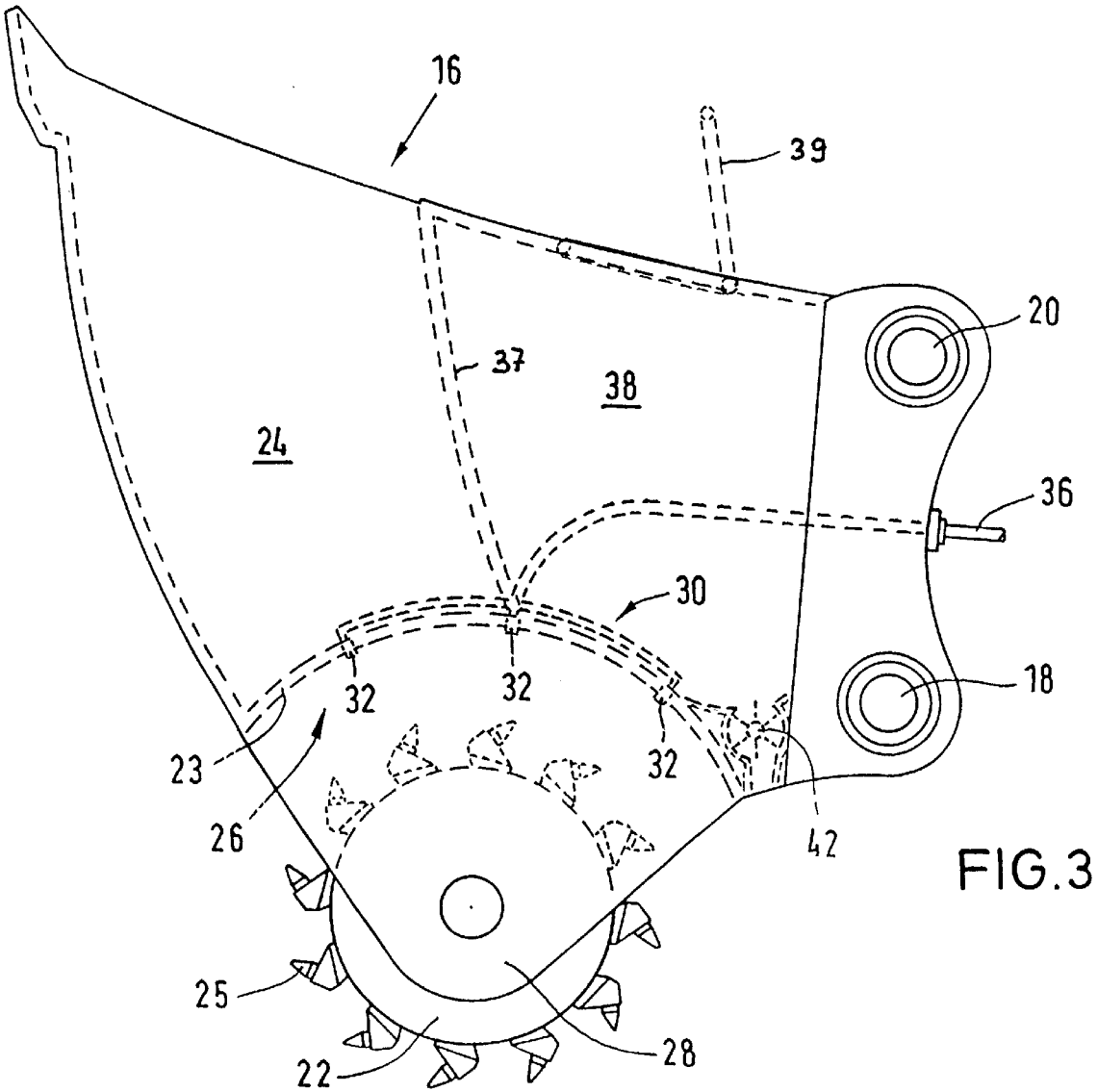
FIG. 3 shows a side view of the excavator bucket with integrated milling/mixing rotor.

As can best be seen in FIG. 3 the milling/mixing rotor 22 is provided with chiselling tools 25, e.g. round-shank chisels. Alternatively paddles or knives can be arranged on the circumferential face of the milling/mixing rotor 22.

Figure 2:
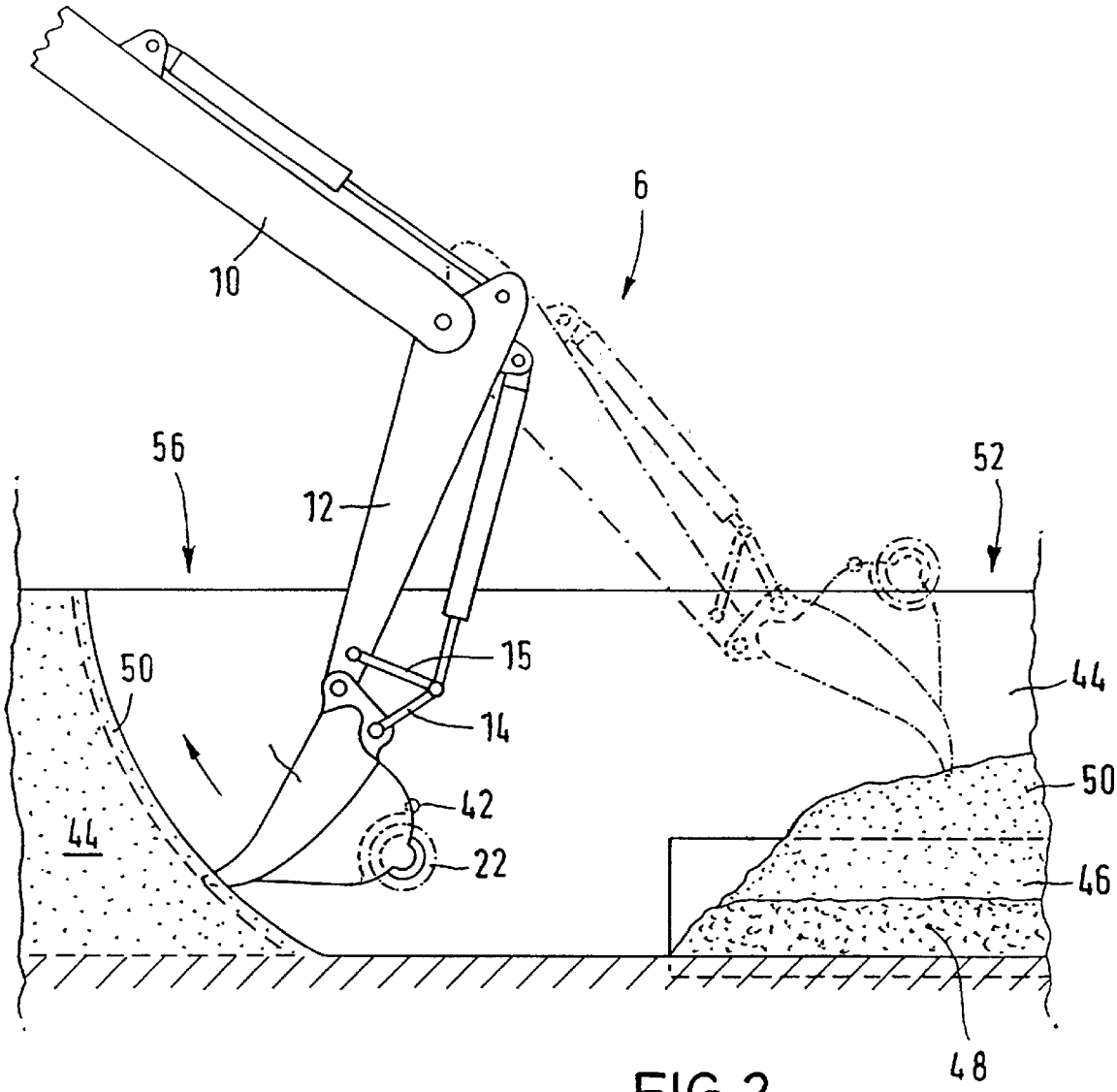
FIG. 2 shows excavation of the treated filler.

The milled material mixed and comminuted in the mixing chamber 26 is deposited by the milling/mixing rotor 22 with a liquid or powdered binder being admixed and can be excavated in a subsequent excavation process after having been treated, as shown in FIG. 2, and placed as filler 50 onto the pipes 46 in the ditch section 52, as shown in FIG. 2 by a dashed line. Owing to its track gauge the excavator can be moved towards the first ditch section 52 in order to unload the filler 50.

The excavator bucket 16 comprises in the front area a receiving chamber 24 for the excavated material and downstream of the receiving chamber 24 a storage chamber 38 for powdered binder with the storage chamber 38 being separated from the receiving chamber 24 by a partition 37. The storage chamber 38 can be filled with powdered binder from top via a damper 39.

Said storage chamber 38 is dimensioned such that powdered binder for at least one ditch section can be received. A rotary lock 42 arranged axially parallel to the milling/mixing rotor 22 is disposed laterally adjacent to the covering hood 23 and feeds the powdered binder from the storage chamber 38 to the layer excavated from the ditch. The powdered binder is thoroughly mixed with the loosened and comminuted material with the aid of the milling/mixing rotor 22. At the same time liquid binder can be fed via a supply line 36 to the excavator bucket 16 with the liquid binder being injected directly into the mixing chamber 26 via e.g. three spray units 32 arranged parallel to the milling/mixing rotor 22. The addition of powdered and/or liquid binder allows the soil to be treated such that the soil can be used as filler in the upstream ditch section 52. The liquid binder is prepared in a suspension mixer and supplied via the supply line 36 to the excavator bucket 16.

The storage chamber 38 for the powdered binder can e.g. be intermittently topped up with binder via a pneumatic supply line.

Dosing of the binder to be added, either solid or liquid, is effected with the aid of the control unit.

It is paricularly advantageous that digging and backfilling of the ditch do not require different site vehicles since the excavator bucket comprises an integrated milling/mixing rotor 22. In this way the time and material required are considerably reduced with the waste volume being simultaneously decreased to a small remainder. Purchase of filler, including the expensive transport of the filler, is not necessary.

Although a preferred embodiment of the invention has been specifically illustrated and described herein, it is to be understood that minor variations may be made in the apparatus without departing from the spirit and scope of the invention, as defined the appended claims.

What is claimed is:

1. A device for excavating and backfilling of soil (44), in particular for laying pipes in ditches, comprising an automotive travelling mechanism (2) carrying a machine frame (4) with an upper structure, a boom (6) pivoted to the machine frame (4), said boom having a plurality of boom arms (8, 10, 12) pivotally connected to each other, an excavator bucket (16) pivoted to a free end of the boom (6), a milling/mixing rotor (22) being arranged on the on the excavator bucket (16), and the excavator bucket (16) being divided into a receiving chamber (24) for the excavated material, a storage chamber (38) for powdered binder and a mixing chamber (26) surrounding the milling/mixing rotor (22).

2. The device according to claim 1 characterized in that a spray device (30) sprays liquid binder into the mixing chamber (26) for the excavator bucket (16).

3. The device according to claim 2 characterized in that the spray device (30) comprises a plurality of spray nozzles (34) directed towards the milling/mixing rotor (22).

4. The device according to claim 1 characterized in that the excavator bucket (16) comprises a distribution means (42) for powdered binder.

5. The device according to claim 1 characterized in that in the working direction of the milling/mixing motor (22) downstream of the milling/mixing rotor (22) a rotary lock (42) conveying powdered binder from the storage chamber (38) is arranged as a distribution means.

6. The device according to claim 1 characterized in that a control unit controls the path of the excavator bucket (16) in dependence on the position of the boom arms (8, 10, 12, 14) with a given milling depth being adjusted.

7. The device according to claim 1 characterized in that a segment of the milling/mixing rotor (22) in the excavator bucket (16) is surrounded by circularly curved covering hood (23) defining the mixing chamber (26).

8. The device according to claim 7 characterized in that the milling/mixing rotor (22) is mounted on the side walls (28) of the excavator bucket (16) laterally defining the covering hood (23).

9. The device according to claim 8 characterized in that the spray device (30) comprises one or a plurality of spray unit/spray units (32) integrated in the covering hood (23).

10. The device according to claim 1 characterized in that the milling/mixing rotor (22) comprises round-shank chisels (25), paddles or knives on its circumferential face.

11. The device according to claim 10 characterized in that the spray device (30) comprises one or a plurality of spray unit/spray units (32) integrated in the covering hood (23).

12. A device for excavating and backfilling of soil (44) to be attached to site vehicles comprising a boom (6), an excavator bucket (16), at least one pivot (18, 20) for coupling the excavator bucket (16) to the boom (6), a milling/mixing rotor (22) being arranged on the excavator bucket (16), and the excavator bucket (16) being divided into a receiving chamber (24) for the excavated material, a storage chamber (38) for powdered binder and a mixing chamber (26) surrounding the milling/mixing rotor (22).

13. The device according to claim 12 characterized in that a spray device (30) sprays liquid binder into the mixing chamber (26) for the excavator bucket (16).

14. The device according to claim 13 characterized in that the spray device (30) comprises a plurality of spray nozzles (34) directed towards the milling/ mixing rotor (22).

* * * * *